US011759012B1

(12) United States Patent
Li

(10) Patent No.: US 11,759,012 B1
(45) Date of Patent: Sep. 19, 2023

(54) SHELF

(71) Applicant: XIAMEN JIREE IMPORT AND EXPORT CO., LTD., Fujian (CN)

(72) Inventor: Xin Li, Xiamen (CN)

( * ) Notice: Subject to any disclaimer, the term of this patent is extended or adjusted under 35 U.S.C. 154(b) by 0 days.

(21) Appl. No.: 17/876,551

(22) Filed: Jul. 29, 2022

(30) Foreign Application Priority Data

May 24, 2022 (CN) ..... 202221261941.7

(51) Int. Cl.
*A47B 96/02* (2006.01)
*E05D 5/10* (2006.01)
*A47B 57/26* (2006.01)

(52) U.S. Cl.
CPC ..... *A47B 96/021* (2013.01); *A47B 57/265* (2013.01); *A47B 96/025* (2013.01); *A47B 96/028* (2013.01); *E05D 5/10* (2013.01)

(58) Field of Classification Search
CPC ..... A47B 96/021; A47B 96/025; A47B 57/04; A47B 57/045; A47B 57/265; A47B 96/028; A47B 57/26; A47B 57/10; A47B 57/22; E05D 5/10; E05D 15/522; E05D 5/12; E05D 7/0018; E05D 7/0045
See application file for complete search history.

(56) References Cited

U.S. PATENT DOCUMENTS 2,001,364 A * 5/1935 Larsson ..... A47B 5/04 108/134
2,042,517 A * 6/1936 Ellis ..... F25D 25/02 211/99
2,732,581 A * 1/1956 Heck ..... E05D 5/10 16/257
3,126,120 A * 3/1964 Crate ..... E05D 5/10 220/844
5,794,385 A * 8/1998 Donovan ..... A01K 1/035 49/70
6,138,851 A * 10/2000 Townson ..... B65D 11/1833 220/691
6,918,502 B1 * 7/2005 Overholt ..... A45C 7/0036 220/6
9,290,288 B1 * 3/2016 Ikeno ..... A47B 55/06
10,065,763 B2 * 9/2018 Wilcox ..... B65D 21/086
10,260,262 B2 * 4/2019 Jiang ..... E05D 3/02
10,415,613 B2 * 9/2019 Boo ..... A47B 88/941
10,427,831 B2 * 10/2019 Jiang ..... B65D 25/2897
2004/0000030 A1 * 1/2004 Pleiman ..... E05D 1/04 16/267
2017/0342753 A1 * 11/2017 Jiang ..... E05D 3/02
2018/0080488 A1 * 3/2018 Derelöv ..... A47F 5/0846

* cited by examiner

*Primary Examiner* — Ko H Chan

(57) ABSTRACT

A shelf includes a bottom plate, a vertical plate, and a side plate. The bottom plate and the vertical plate are pivotally connected through a pivot mechanism and a first restricting mechanism that are disposed at a pivot joint of the bottom plate and the vertical plate. The pivot mechanism includes a rotating shaft disposed on the bottom plate and a first engaging hook disposed on the vertical plate. The first engaging hook is configured to catch the rotating shaft. The first restricting mechanism is configured to restrict a maximum unfolding angle of the bottom plate and the vertical plate. A second restricting mechanism is provided between the side plate and the vertical plate. The shelf simplifies installation steps and reduces installation and transportation costs.

17 Claims, 12 Drawing Sheets

SHELF

BACKGROUND OF THE INVENTION

1. Field of the Invention

The present invention relates to a shelf and more particularly to a novel shelf.

2. Description of the Prior Art

Shelves are small furniture commonly used in our daily life for placing and storing items. In general, they are classified into floor shelves and wall-mounted shelves. In order to realize the storage of the shelf and reduce the transportation cost, there are various types of foldable shelves on the market. The space occupied by the foldable shelf can be reduced greatly in a folded state.

In a foldable shelf composed of multiple plates, the plates are assembled through hinges. As a result, the whole product has many components, which increases the costs of the components formed by injection molding and product packaging. In assembly, the hinges need to be locked by means of screws, etc., the assembly is cumbersome, the efficiency is low, and the user experience is poor.

SUMMARY OF THE INVENTION

The primary object of the present invention is to provide a shelf, which can simplify the product structure, thereby simplifying installation steps and reducing installation and transportation costs.

In order to achieve the above object, the present invention adopts the following technical solutions:

A shelf comprises a bottom plate, a vertical plate, and a side plate. The bottom plate and the vertical plate are pivotally connected through a pivot mechanism and a first restricting mechanism that are disposed at a pivot joint of the bottom plate and the vertical plate. The pivot mechanism includes a rotating shaft disposed on one side edge of the bottom plate and a first engaging hook disposed on one side of the vertical plate. The first engaging hook is configured to catch the rotating shaft. The first restricting mechanism is configured to restrict a maximum unfolding angle of the bottom plate and the vertical plate. A second restricting mechanism is provided between the side plate and the vertical plate. When the bottom plate is unfolded to the maximum unfolding angle relative to the vertical plate, the side plate is fitted with the vertical plate through the second restricting mechanism. The second restricting mechanism restricts the side plate from moving forward and backward and upward relative to the vertical plate.

The side edge of the bottom plate has a notch. The rotating shaft is disposed in the notch. The side of the vertical plate has a pivot portion. The first engaging hook is disposed at one end of the pivot portion.

The first engaging hook has an opening facing upward.

The first restricting mechanism includes a first restricting block disposed on the side edge of the bottom plate and a first restricting groove disposed on the side of the vertical plate. The first restricting block is rotatably fitted in the first restricting groove. The first restricting block has a curved surface and a first flat surface. The first restricting groove has a second flat surface therein. When the bottom plate is folded relative to the vertical plate, the curved surface is rotated in the first restricting groove. When the bottom plate is unfolded relative to the vertical plate, the first flat surface is attached to the second flat surface to restrict the maximum unfolding angle of the bottom plate and the vertical plate.

The first restricting mechanism includes two first restricting mechanisms located at both ends of the pivot joint of the bottom plate and the vertical plate. The pivot mechanism is plural and located between the first restricting mechanisms.

The pivot mechanisms are arranged at equal intervals.

The second restricting mechanism includes a second restricting block disposed on a side edge of the vertical plate and a second restricting groove disposed on one side of the side plate. The second restricting block includes a restricting portion and a movable portion that are vertically connected. The movable portion slides into the second restricting groove in an upper-to-lower direction, so that the restricting portion is fitted to an upper end of the second restricting groove.

The second restricting groove includes two symmetrical second engaging hooks protruding from the side of the side plate. The movable portion of the second restricting block is in clearance fit with the second engaging hooks. The restricting portion has a width greater than a distance between the second engaging hooks.

An outer surface of each second engaging hook has a first guide slope.

The width of the restricting portion gradually decreases from top to bottom.

The second restricting groove is formed by two symmetrical ribs protruding from the side of the side plate.

A third restricting mechanism is provided at the pivot joint of the bottom plate and the vertical plate. The third restricting mechanism includes an engaging buckle disposed on the side edge of the bottom plate and a third restricting block disposed on the side of the vertical plate. The engaging buckle protrudes from a lower surface of the side edge of the bottom plate. The third restricting block has a countersunk hole or through hole extending vertically. The engaging buckle is inserted in the third restricting block in an upper-to-lower direction. When the bottom plate is unfolded relative to the vertical plate, the third restricting block is restricted by the engaging buckle for restricting the unfolding angle of the bottom plate and the vertical plate.

A protruding step is provided on the side of the side plate for supporting one end of the bottom plate.

A fourth restricting mechanism is provided between the side plate and the vertical plate. The fourth restricting mechanism includes a restricting notch disposed on a side edge of the vertical plate and a fourth restricting block disposed on one side of the side plate. The fourth restricting block is engaged in the restricting notch for restricting downward movement of the side plate relative to the vertical plate.

The second restricting groove includes a plurality of second restricting grooves arranged in a plurality of rows corresponding in number to the vertical plate. The fourth restricting block is located under a lowermost one of the second restricting grooves in the same row.

An upper surface of the fourth restricting block has a second guide slope.

The shelf further comprises a restricting plate. The restricting plate has a receiving groove for receiving the vertical plate. The vertical plate further has a slide groove corresponding in position to the restricting plate. The vertical plate is inserted in the receiving groove of the restricting plate, and the restricting plate slides in the slide groove of the vertical plate, so as to realize a vertical connection between the vertical plate and the restricting plate.

By adopting the above-mentioned technical solutions, the present invention has the following technical effects:

1. The pivot mechanism and the first restricting mechanism are disposed at the pivot joint of the bottom plate and the vertical plate, thereby providing pivotal and restricting functions between the bottom plate and the vertical plate. The pivotal function enables the product to fold the bottom plate and the vertical board after removing the side plate, which reduces the space occupation and facilitates storage, packaging and transportation. The restricting function restricts the maximum angle of the bottom plate relative to the vertical plate after being unfolded. When the product is to be assembled, the bottom plate and the vertical plate can be unfolded to the maximum angle, which is beneficial for the assembly of the side plate, reduces assembly difficulty and improves assembly efficiency.

2. Because the pivot mechanism is composed of the rotating shaft and the first engaging hook, the installation steps and installation costs are greatly simplified by means of snap fit.

3. The restricting effect of the second restricting mechanism on the vertical plate and the side plate plays the role of retaining the bottom plate and the vertical plate after they are unfolded, and realizes the stable function of the overall structure of the product. The shelf is not easy to shake when in use.

DETAILED DESCRIPTION OF THE PREFERRED EMBODIMENTS

Figure 1:
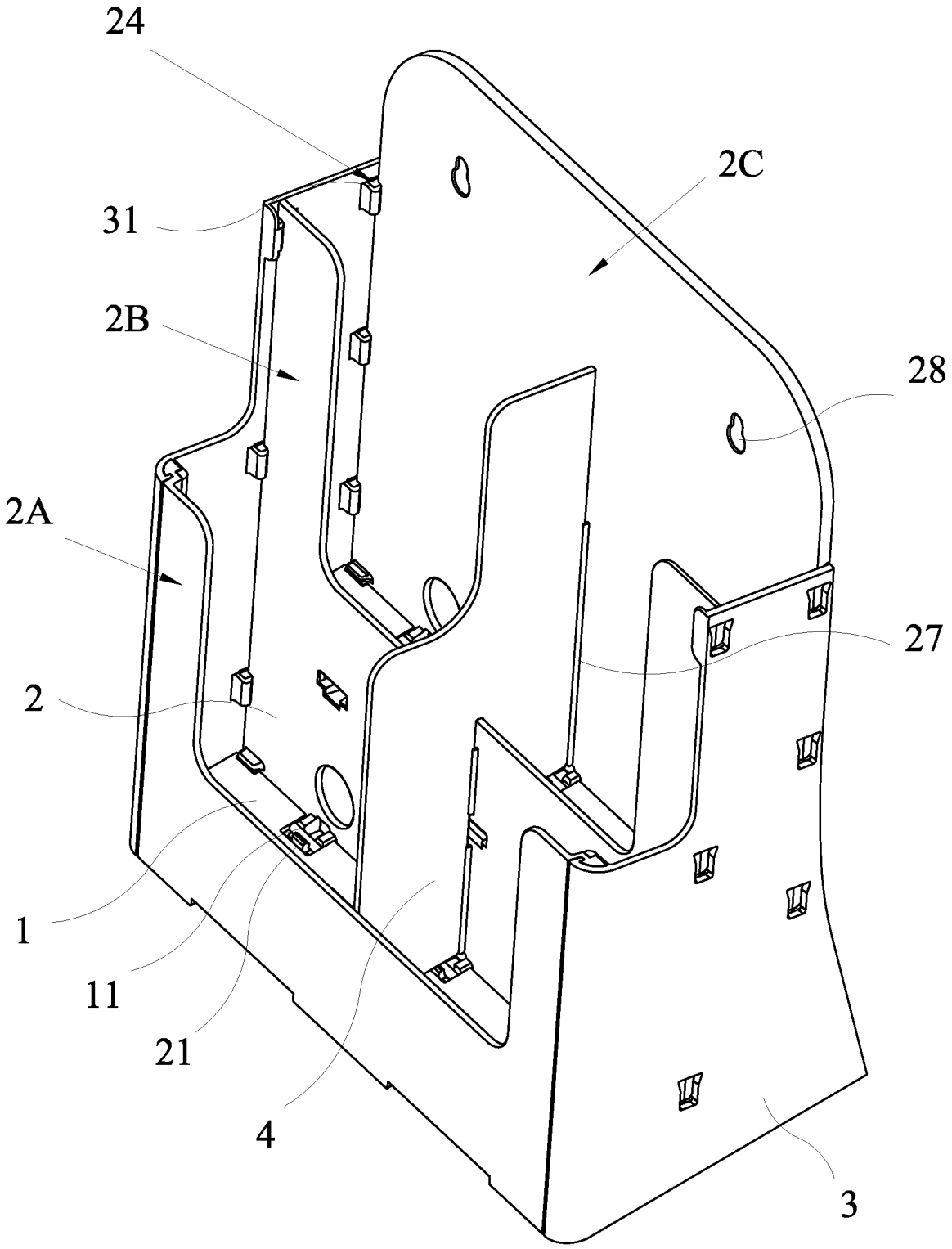
FIG. 1 is a first perspective view according to a preferred embodiment of the present invention.
Figure 2:
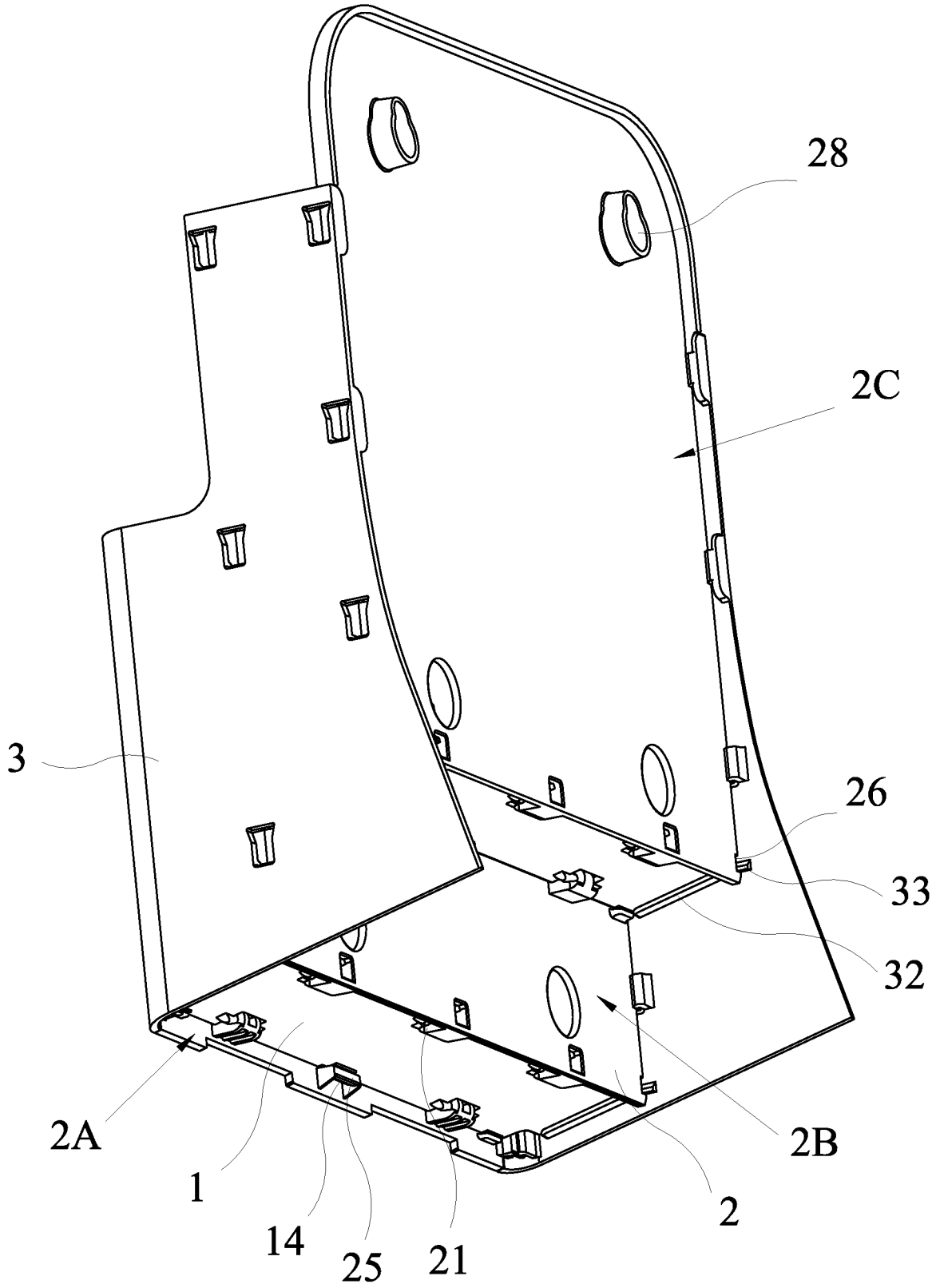
FIG. 2 is a second perspective view according to the preferred embodiment of the present invention.
Figure 3:
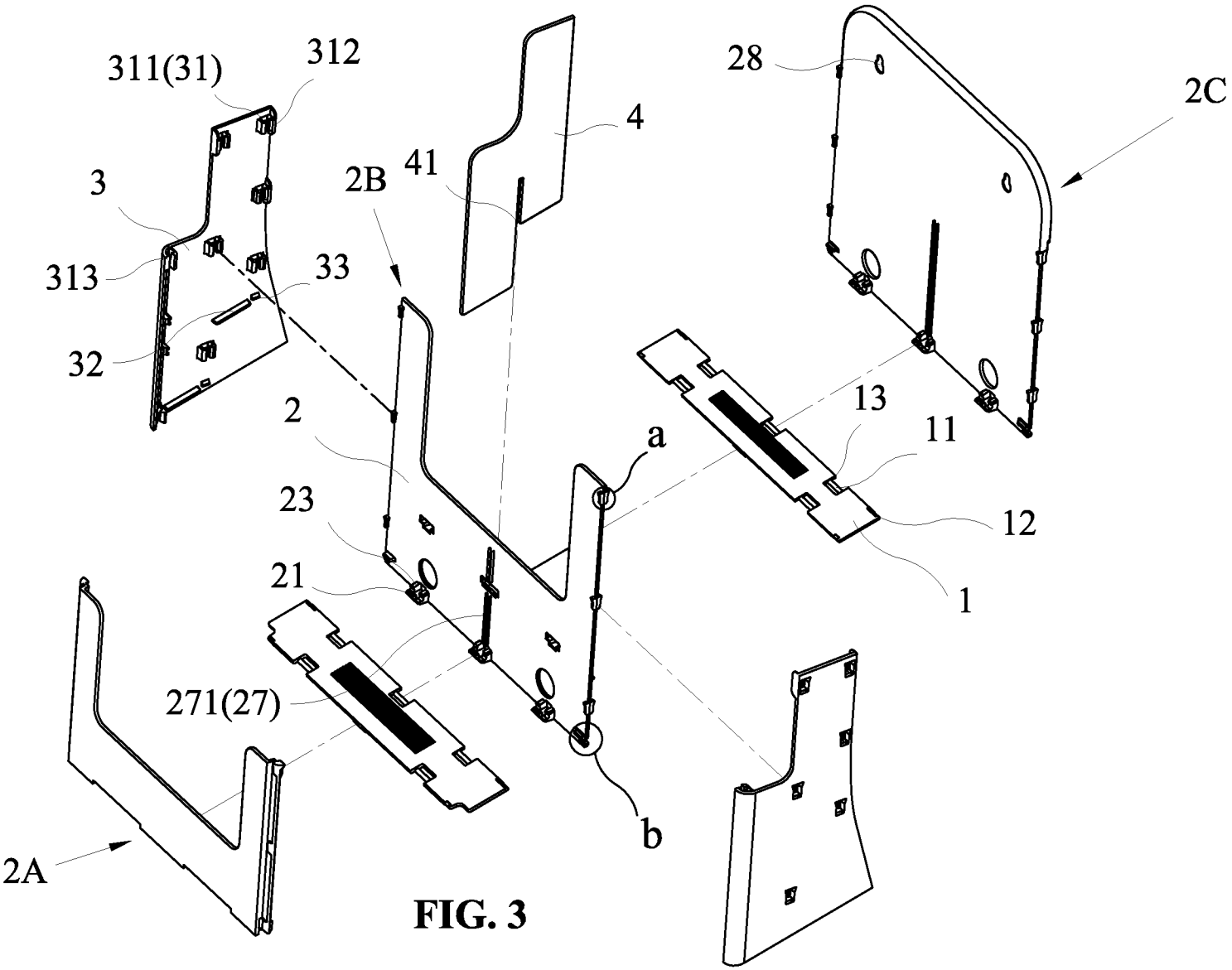
FIG. 3 is a first exploded view according to the preferred embodiment of the present invention.
Figure 4:
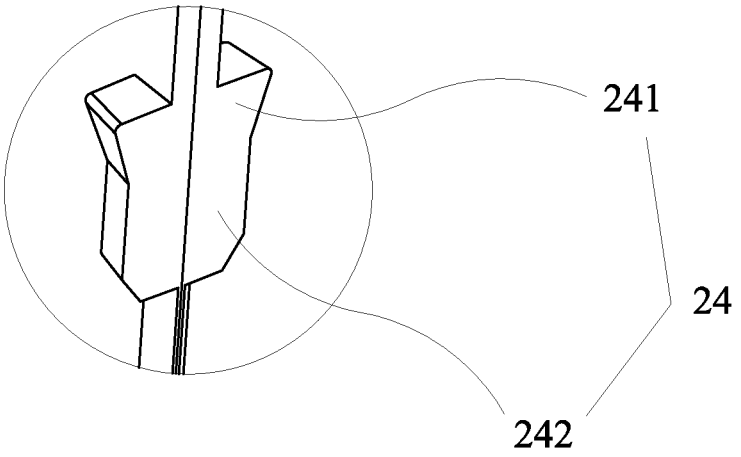
FIG. 4 is an enlarged view of circle a of FIG. 3.
Figure 5:
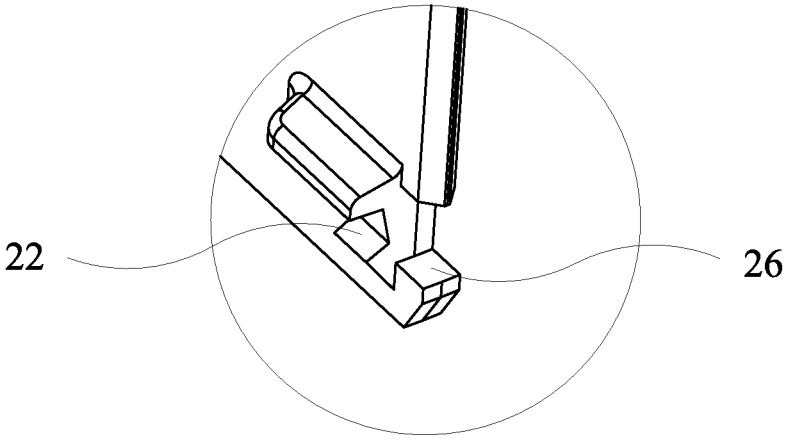
FIG. 5 is an enlarged view of circle b of FIG. 3.
Figure 6:
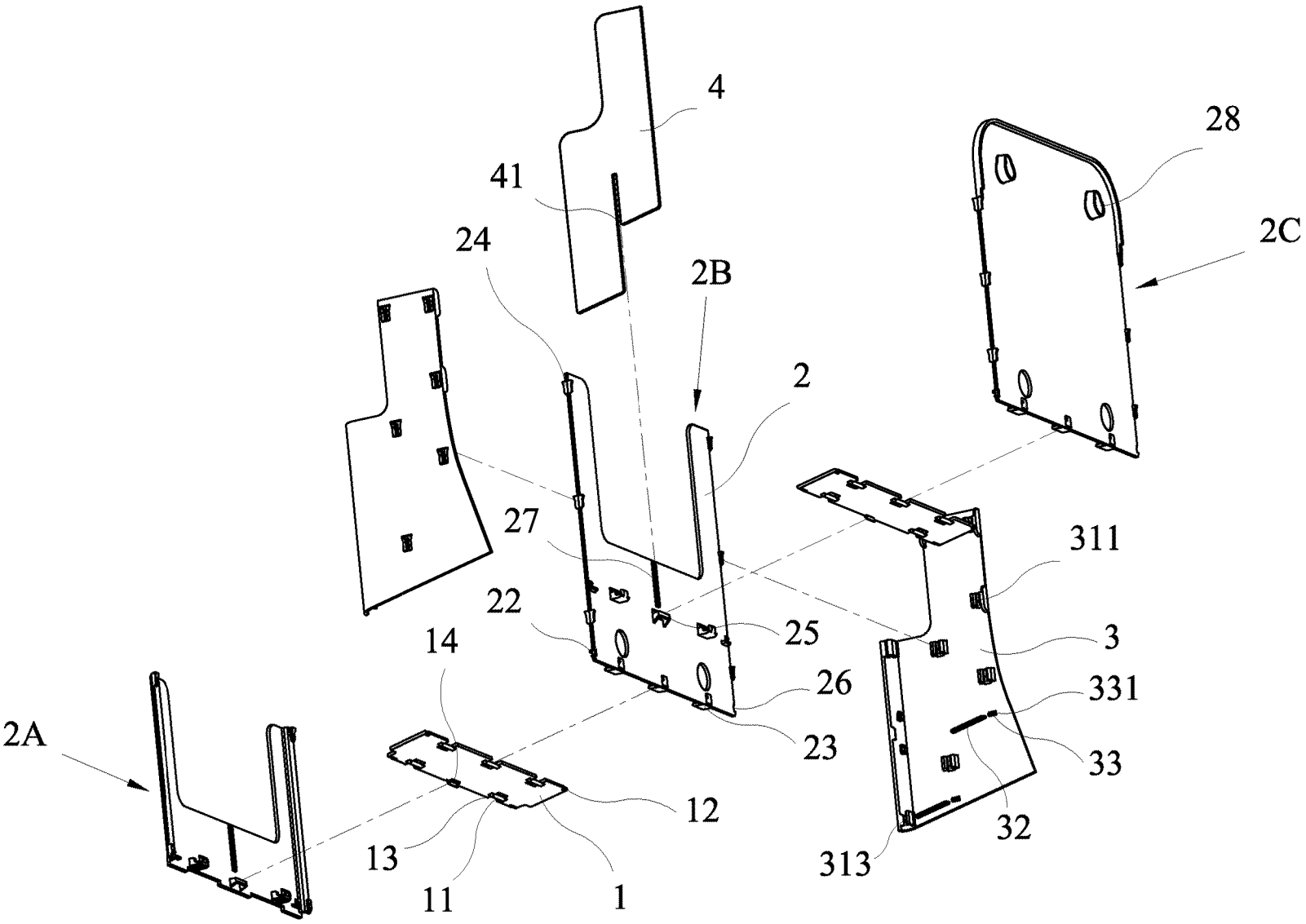
FIG. 6 is a second exploded view according to the preferred embodiment of the present invention.
Figure 7:
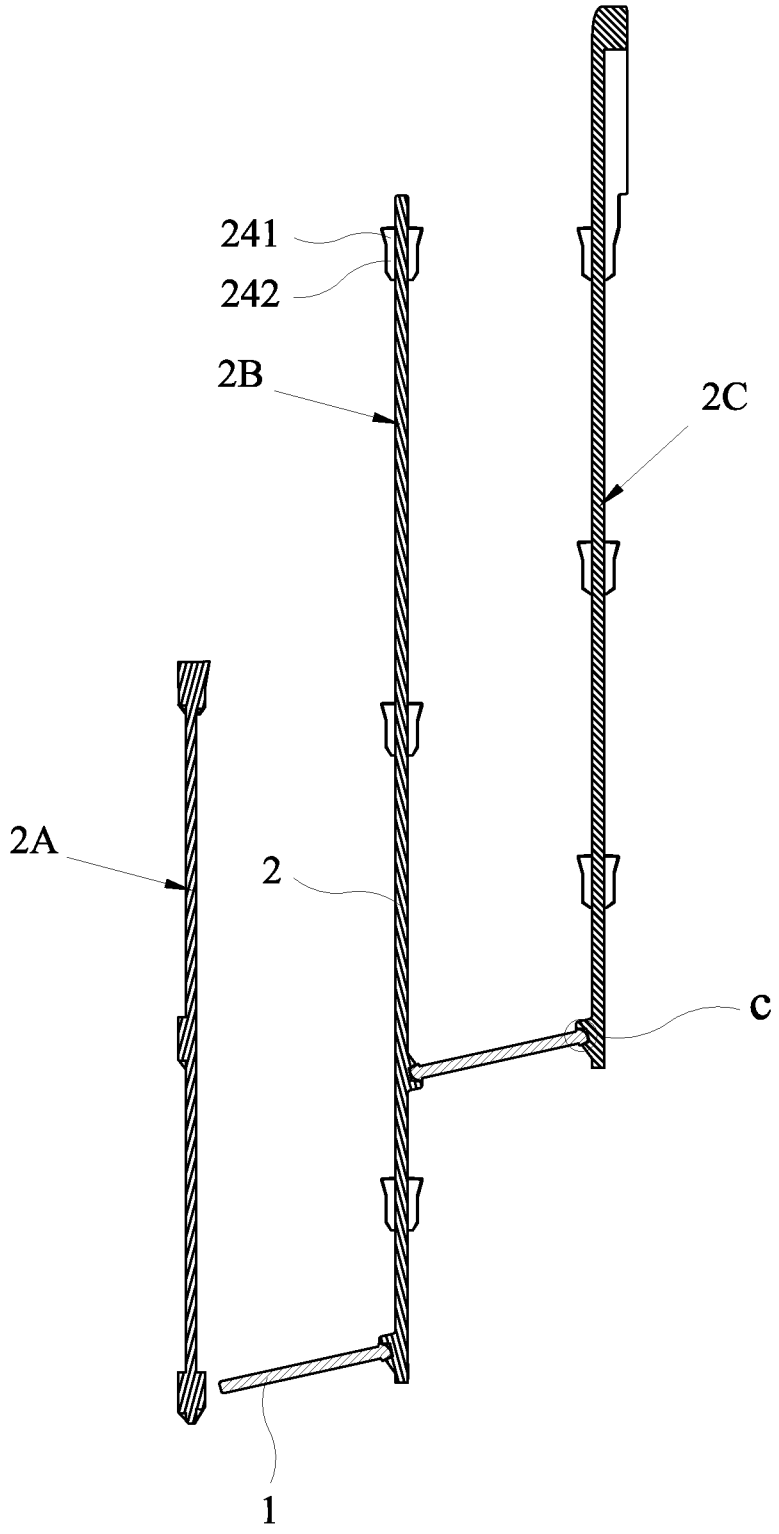
FIG. 7 is a first cross-sectional view showing the assembly of the bottom plate and the vertical plate according to the preferred embodiment of the present invention.
Figure 8:
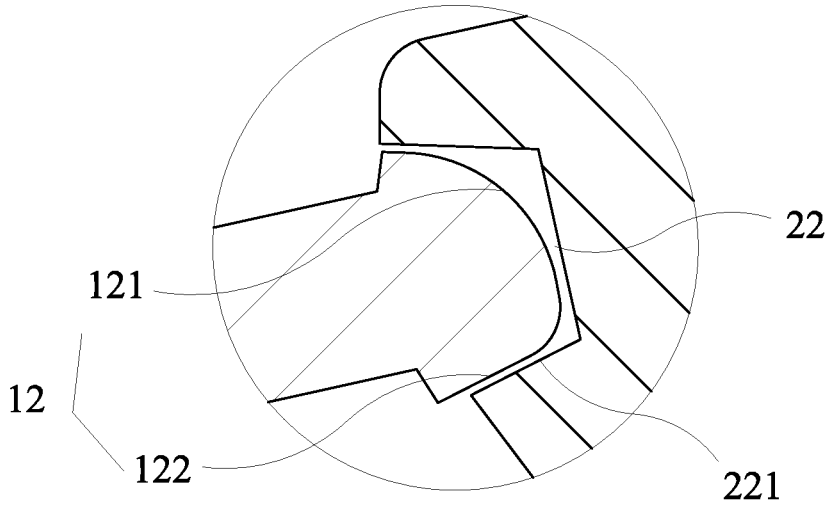
FIG. 8 is an enlarged view of circle c of FIG. 7.
Figure 9:
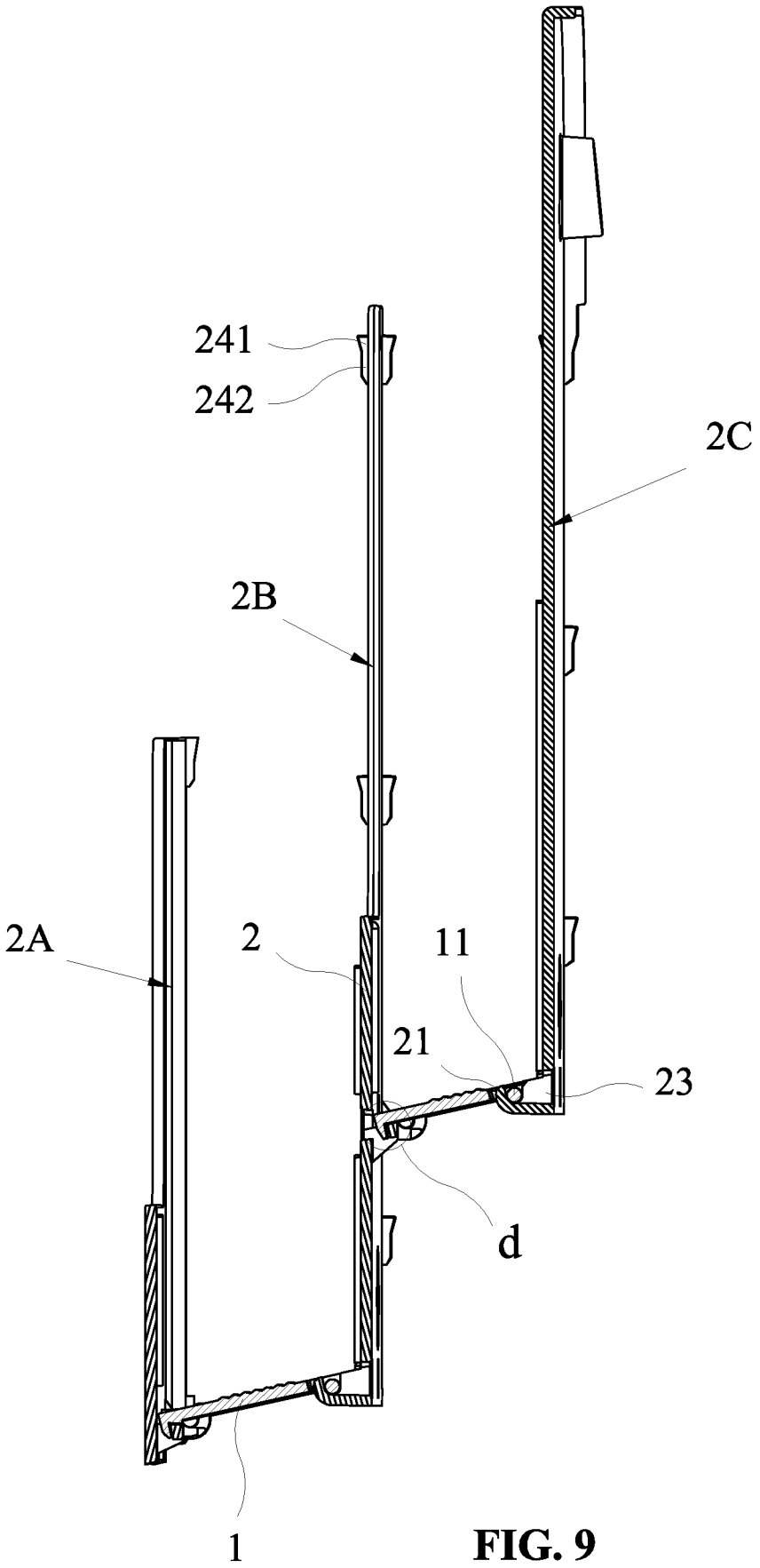
FIG. 9 is a second cross-sectional view showing the assembly of the bottom plate and the vertical plate according to the preferred embodiment of the present invention.
Figure 10:
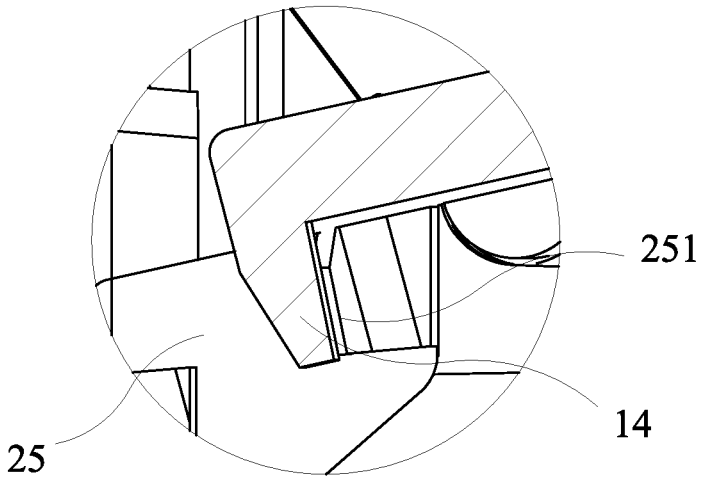
FIG. 10 is an enlarged view of circle d of FIG. 9.

The present invention discloses a shelf comprising a bottom plate 1, a vertical plate 2 and a side plate 3.

The bottom plate 1 and the vertical plate 2 are pivotally connected through a pivot mechanism and a first restricting mechanism that are disposed at the pivot joint of the bottom plate 1 and the vertical plate 2.

The pivot mechanism includes a rotating shaft 11 disposed on one side edge of the bottom plate 1 and a first engaging hook 21 disposed on one side of the vertical plate 2. The first engaging hook 21 is configured to catch the rotating shaft 11. The first restricting mechanism is configured to restrict the maximum unfolding angle of the bottom plate 1 and the vertical plate 2.

A second restricting mechanism is provided between the side plate 3 and the vertical plate 2. When the bottom plate 1 is unfolded to the maximum unfolding angle relative to the vertical plate 2, the side plate 3 is assembled with the vertical plate 2 through the second restricting mechanism. The second restricting mechanism restricts the side plate 3 from moving forward and backward and upward relative to the vertical plate 2.

FIGS. 1 to 10 show an embodiment of the present invention.

The side edge of the bottom plate 1 has a notch 13. The rotating shaft 11 is disposed in the notch 13. The side of the vertical plate 2 has a pivot portion 23. The first engaging hook 21 is disposed at the end of the pivot portion 23. Since the pivot portion 23 protrudes from the side of the vertical plate 2, when the product is folded, the bottom plate 1 is folded to the space between the adjacent vertical plates 2. This minimizes the space occupied by the product after the entire product is folded and saves storage, packaging and transportation costs.

The opening of the first engaging hook 21 faces upward. When the product is unfolded, the rotating shaft 11 is restricted by the first engaging hook 21, and the first engaging hook 21 can support the side edge of the bottom plate 1, so that the bottom plate 1 has a stronger load-bearing capacity.

The first restricting mechanism includes a first restricting block 12 disposed on the side edge of the bottom plate 1 and a first restricting groove 22 disposed on the side of the vertical plate 2. The first restricting block 12 is rotatably fitted in the first restricting groove 22. The first restricting block 12 has a curved surface 121 and a first flat surface 122. The first restricting groove 22 has a second flat surface 221 therein. When the bottom plate 1 is folded relative to the vertical plate 2, the curved surface 121 is rotated in the first restricting groove 22. When the bottom plate 1 is unfolded relative to the vertical plate 2, the first flat surface 122 is attached to the second flat surface 221 to restrict the maximum unfolding angle of the bottom plate 1 and the vertical plate 2, so that the bottom plate 1 cannot be turned downward relative to the vertical plate 2. At this time, it is convenient to assemble the side plate 3 on the side of the vertical plate 2.

The first restricting mechanism includes two first restricting mechanisms located at both ends of the pivot joint of the bottom plate 1 and the vertical plate 2. The pivot mechanism is plural and located between the first restricting mechanisms Considering that the first restricting mechanism plays the role of restricting the unfolding angle of the bottom plate 1 and the vertical plate 2, the pivot mechanism assumes more load-bearing role in the whole product. A plurality of pivot mechanisms are disposed between both ends of the pivot joint of the bottom plate 1 and the vertical plate 2 (as shown in the accompanying drawings, there are 2-3 pivot mechanisms) This not only ensures smoother folding and unfolding of the product but also improves the overall load-bearing capacity of the product. By providing a plurality of pivot mechanisms, the pivot joint of the bottom plate 1 and the vertical plate 2 won't be deformed easily.

Furthermore, the pivot mechanisms are arranged at equal intervals, so that the overall load-carrying capability and stability of the product are more balanced. Of course, in other embodiments, the distances between the pivot mechanisms may be unequal.

The second restricting mechanism includes a second restricting block 24 disposed on a side edge of the vertical plate 2 and a second restricting groove 31 disposed on one side of the side plate 3. The second restricting block 24 includes a restricting portion 241 and a movable portion 242 that are vertically connected. The movable portion 242 slides into the second restricting groove 31 in an upper-to-lower direction, so that the restricting portion 241 is fitted to the upper end of the second restricting groove 31. Under the action of the restricting portion 241, when the side plate 3 is to be moved upward relative to the vertical plate 2, the upper end of the second limiting groove 31 abuts against the restricting portion 241 and cannot continue to move. The cooperation of the second restricting groove 31 and the movable portion 242 restricts the forward or backward movement of the side plate 3 relative to the vertical plate 2.

Furthermore, the second restricting groove 31 includes two symmetrical second engaging hooks 311 protruding from the side of the side plate 3. The movable portion 242 of the second restricting block 24 is in clearance fit with the second engaging hooks 311. The width of the restricting portion 241 is greater than the distance between the second engaging hooks 311. The clearance fit between the movable portion 242 and the second engaging hooks 311 ensures that the relative movement of the side plate 3 and the vertical plate 2 is smooth in assembly, is not jammed easily, and has a good installation feel.

Furthermore, the outer surface of the second engaging hook 311 has a first guide slope 312. When the side plate 3 and the vertical plate 2 are installed, the other portion of the side edge of the vertical plate 2 except the second restricting block 24 is first aligned with and inserted in the second restricting groove 31, and then the vertical plate 2 is moved downward so that the second restricting block 24 is matched with the second restricting groove 31. The installation is simpler and faster.

The width of the restricting portion 241 gradually decreases from top to bottom, so the cross-section of the restricting portion 241 is an inverted trapezoid. The upper end of the second restricting groove 31 corresponds in shape to the restricting portion 241, so that the second restricting block 24 is matched with the second limiting groove 31 more tightly.

In addition to the second restricting groove 31 formed by the second engaging hooks 311, in other implementations of the second restricting groove 31, the second restricting groove 31 may be formed by two symmetrical ribs 313 protruding from the side of the side plate 3. The function of the first restricting mechanism is realized by the tight fit between the ribs 313 and the second restricting block 24.

A third restricting mechanism is provided at the pivot joint of the bottom plate 1 and the vertical plate 2. The third restricting mechanism includes an engaging buckle 14 disposed on the side edge of the bottom plate 1 and a third restricting block 25 disposed on the side of the vertical plate 2. The engaging buckle 14 protrudes from the lower surface of the side edge of the bottom plate 1. The third restricting block 25 has a countersunk hole or through hole 251 extending vertically. The engaging buckle 14 is inserted into the countersunk hole/through hole 251 of the third restricting block 25 in an upper-to-lower direction. When the bottom plate 1 is unfolded relative to the vertical plate 2, the third restricting block 25 is restricted by the engaging buckle 14 for restricting the unfolding angle of the bottom plate 1 and the vertical plate 2. By providing the third restricting mechanism, the unfolding angle of the bottom plate 1 and the vertical plate 2 can be further restricted. The third restricting mechanism is disposed at a middle position of the pivot joint of the bottom plate 1 and the vertical plate 2, instead of the original pivot mechanism. Therefore, one less rotating shaft 11 is arranged on the side edge of the bottom plate 1, which is beneficial for installation. Furthermore, the third restricting block 25 plays a support role on the side edge of the bottom plate 1, thereby further improving the overall load-bearing capacity of the product.

A protruding step 32 is provided on the side of the side plate 3 for supporting the end of the bottom plate 1. The support for the bottom plate 1 of the product depends on the pivot mechanism and the first restricting mechanism, both of which are located on the side edge of the bottom plate 1. The step 32 provided on the side plate 3 can support the end of the bottom plate 1, so that the overall structure of the product is more stable and firm.

A fourth restricting mechanism is provided between the side plate 3 and the vertical plate 2. The fourth restricting mechanism includes a restricting notch 26 disposed on the side edge of the vertical plate 2 and a fourth restricting block 33 disposed on the side of the side plate 3. The fourth restricting block 33 is engaged in the restricting notch 26 for restricting the downward movement of the side plate 3 relative to the vertical plate 2. Under the action of the second restricting mechanism, the upward movement of the side plate 3 relative to the vertical plate 2 is restricted; under the action of the fourth restricting mechanism, the downward movement of the side plate 3 relative to the vertical plate 2 is restricted, so as to keep the positional stability of the side plate 3 and the vertical plate 2. That is, after the side plate 3 and the vertical plate 2 are assembled, they won't shake.

Furthermore, the side plate 3 is provided with a plurality of second restricting grooves 31 arranged in a plurality of rows corresponding to the number of the vertical plates 2. Each row includes a plurality of second restricting grooves 31. The fourth restricting block 33 is located under the lowermost one of the second restricting grooves 31 in the same row. In assembly, the second restricting block 24 and the second restricting groove 31 are aligned and assembled first, and then the restricting notch 26 of the vertical plate 2 is pressed down and passes over the fourth restricting block 33. After the fourth restricting block 33 is inserted into the restricting notch 26, the vertical movement between the side plate 3 and the vertical plate 2 is restricted.

Furthermore, the upper surface of the fourth restricting block 33 has a second guide slope 331, so that the vertical plate 2 can pass over the fourth restricting block 33 easily when the vertical plate 2 is moved downward relative to the side plate 3.

The present invention further comprises a restricting plate 4. The restricting plate 4 has a receiving groove 41 for receiving the vertical plate 2. The vertical plate 2 has a slide groove 27 corresponding in position to the restricting plate 4. The vertical plate 2 is inserted in the receiving groove 41 of the restricting plate 4, and the restricting plate 4 slides in the slide groove 27 of the vertical plate 2, so as to realize the vertical connection between the vertical plate 2 and the restricting plate 4. When the vertical plate 2 is plural, the restricting plate 4 can assist the side plate 3 in restricting the plural vertical plates 2, so as to maintain the distance and improve the stability.

Furthermore, the slide groove 27 includes two flanges 271 protruding from the surface of the vertical plate 2.

Referring to the embodiment of FIGS. 1 to 10, the vertical plate 2 may be a front plate 2A, a partition plate 2B or a back plate 2C of the shelf.

1. When the vertical plate 2 is the front plate 2A, the second restricting mechanism between the vertical plate 2 and the side plate 3 is composed of the second restricting groove 31 including the two ribs 313 and the second restricting block 24. The tight fit of the ribs 313 can prevent the front plate 2A from loosening and falling off.

2. When the vertical plate 2 is the partition plate 2B or the back plate 2C, the second restricting mechanism between the vertical plate 2 and the side plate 3 is composed of the second restricting groove 31 including two second engaging hooks 311 and the second restricting block 24.

3. When the vertical plate 2 is the front plate 2A or the back plate 2C, the bottom edge of one side of the vertical plate 2 is provided with corresponding structures, such as the first engaging hook 21, the first restricting groove 22, the third restricting block 25 and the like, so as to be fitted with the bottom plate 1.

4. When the vertical plate 2 is the partition plate 2B, corresponding structures, such as the first engaging hook 21, the first restricting groove 22, the third restricting block 25 and the like, are provided on both sides of the vertical plate 2, so that both sides of the partition plate 2B can be fitted with the bottom plate 1. The shelf has multiple levels for more storage space. By increasing the number of bottom plates 1 and partition plates 2B, the shelf may be in the form of a two-level, three-level, or four-level shelf to meet the needs of different users. All accessories except the side plate 3 are common. In addition, the corresponding structures on both sides of the partition plate 2B are arranged at different heights (the corresponding structures on one side is located at the bottom edge of the partition plate 2B), so that the shelf has different levels after assembled. It is easier for users to observe the items in the storage space on each level.

5. When the vertical plate 2 is the back plate 2C, the back plate 2C is formed with hanging holes 28, so that the shelf can be wall-mounted.

Figure 11:
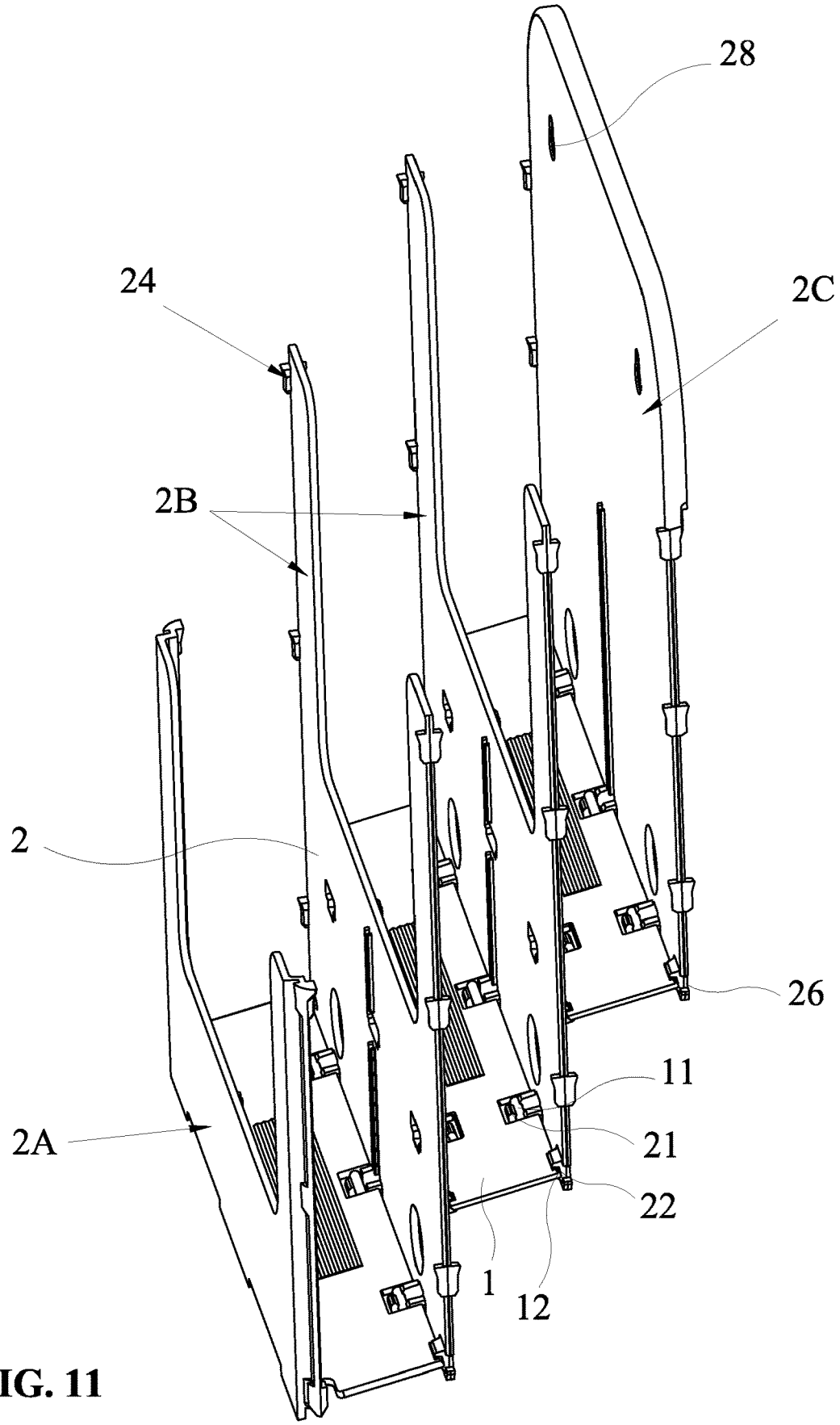
FIG. 11 is a first schematic view according to the preferred embodiment of the present invention when in use.
Figure 12:
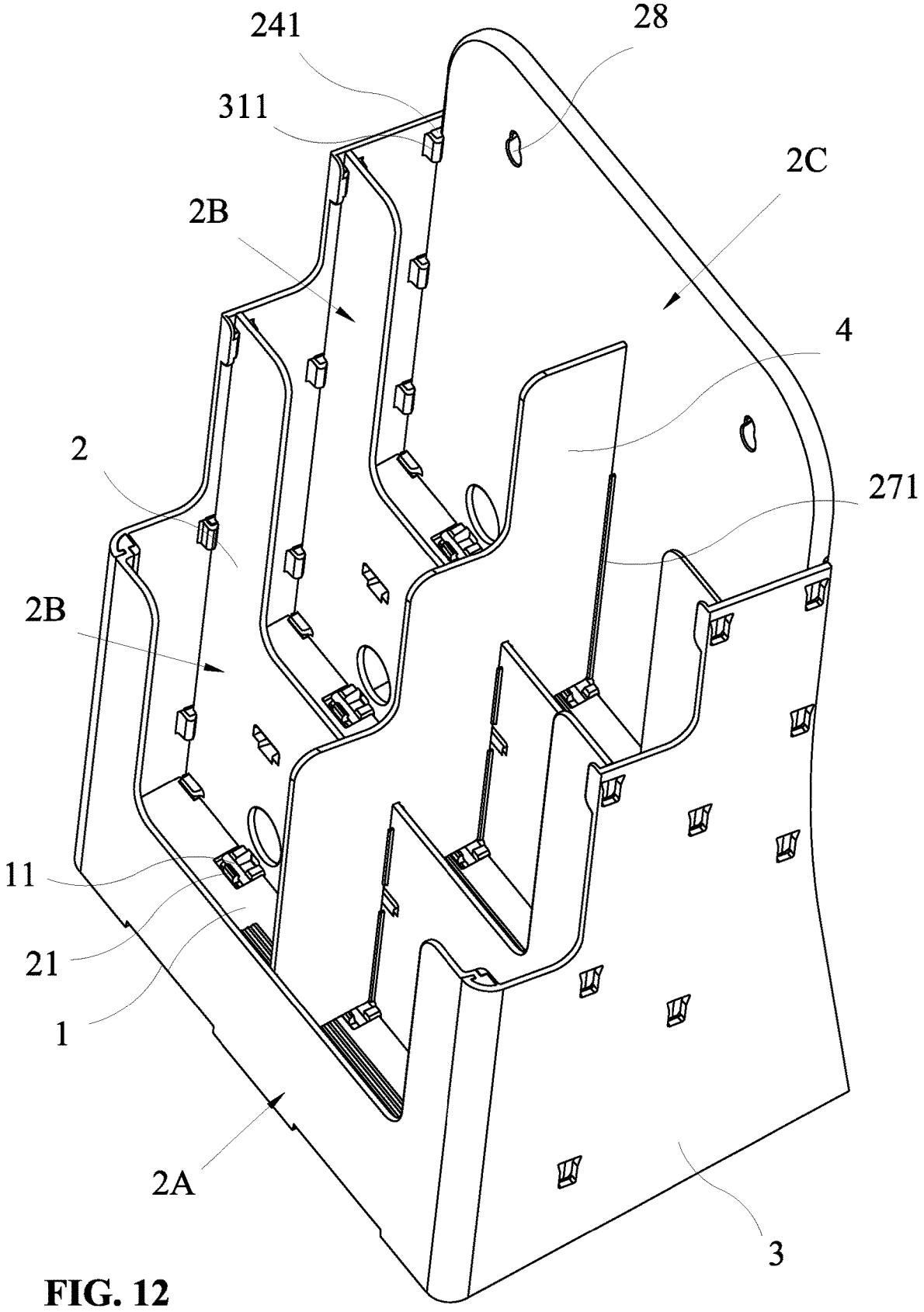
FIG. 12 is a second schematic view according to the preferred embodiment of the present invention when in use.
Figure 13:
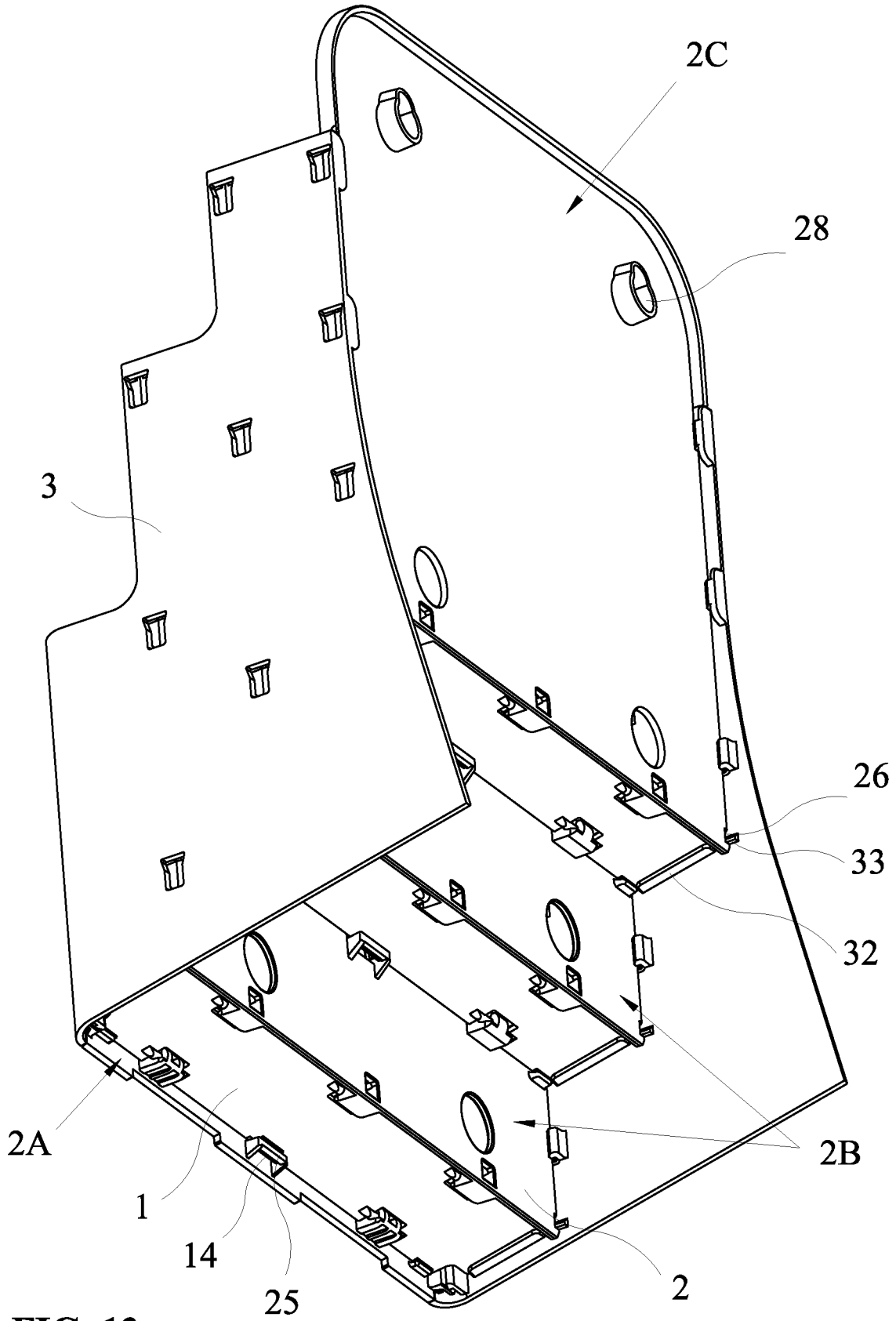
FIG. 13 is a third schematic view according to the preferred embodiment of the present invention when in use.

FIGS. 11 to 13 show the actual use of the present invention.

By adding a set of a bottom plate 1 and a partition plate 2B on the basis of this embodiment, the original two-level shelf can be changed to a three-level shelf, so that the product has a larger and more storage space. Correspondingly, the number of structures, such as the second restricting groove 31, the step 32 and the fourth restricting block 33 of the side plate 3, is also increased.

With the above solutions, in the present invention, the pivot mechanism and the first restricting mechanism are disposed at the pivot joint of the bottom plate 1 and the vertical plate 2, thereby providing pivotal and restricting functions between the bottom plate 1 and the vertical plate 2. The pivotal function enables the product to fold the bottom plate 1 and the vertical board 2 after removing the side plate 3, which reduces the space occupation and facilitates storage, packaging and transportation. The restricting function restricts the maximum angle of the bottom plate 1 relative to the vertical plate 2 after being unfolded. When the product is to be assembled, the bottom plate 1 and the vertical plate 2 can be unfolded to the maximum angle, which is beneficial for the assembly of the side plate 3, reduces assembly difficulty and improves assembly efficiency. Secondly, because the pivot mechanism is composed of the rotating shaft 11 and the first engaging hook 21, the installation steps and installation costs are greatly simplified by means of snap fit. Furthermore, in the present invention, the restricting effect of the second restricting mechanism on the vertical plate 2 and the side plate 3 plays the role of retaining the bottom plate 1 and the vertical plate 2 after they are unfolded, and realizes the stable function of the overall structure of the product. The shelf is not easy to shake when in use.

What is claimed is:

1. A shelf, comprising:

a bottom plate, a vertical plate and a side plate;

the bottom plate and the vertical plate being pivotally connected through a pivot mechanism and a first restricting mechanism that are disposed at a pivot joint of the bottom plate and the vertical plate; the pivot mechanism including a rotating shaft disposed on one side edge of the bottom plate and a first engaging hook disposed on one side of the vertical plate, the first engaging hook being configured to catch the rotating shaft; the first restricting mechanism being configured to restrict a maximum unfolding angle of the bottom plate and the vertical plate;

a second restricting mechanism being provided between the side plate and the vertical plate; wherein when the bottom plate is unfolded to the maximum unfolding angle relative to the vertical plate, the side plate is fitted with the vertical plate through the second restricting mechanism, the second restricting mechanism restricting the side plate from moving forward, backward and upward relative to the vertical plate.

2. The shelf as claimed in claim 1, wherein the side edge of the bottom plate has a notch, the rotating shaft is disposed in the notch; the side of the vertical plate has a pivot portion, and the first engaging hook is disposed at one end of the pivot portion.

3. The shelf as claimed in claim 1, wherein the first engaging hook has an opening facing upward.

4. The shelf as claimed in claim 1, wherein the first restricting mechanism includes a first restricting block disposed on the side edge of the bottom plate and a first restricting groove disposed on the side of the vertical plate; the first restricting block is rotatably fitted in the first restricting groove, the first restricting block has a curved surface and a first flat surface; the first restricting groove has a second flat surface therein; when the bottom plate is folded relative to the vertical plate, the curved surface is rotated in the first restricting groove; when the bottom plate is unfolded relative to the vertical plate, the first flat surface is attached to the second flat surface to restrict the maximum unfolding angle of the bottom plate and the vertical plate.

5. The shelf as claimed in claim 1, wherein the first restricting mechanism includes two first restricting mechanisms located at both ends of the pivot joint of the bottom plate and the vertical plate, and the pivot mechanism is plural and located between the first restricting mechanisms.

6. The shelf as claimed in claim 5, wherein the pivot mechanisms are arranged at equal intervals.

7. The shelf as claimed in claim 1, wherein the second restricting mechanism includes a second restricting block disposed on a side edge of the vertical plate and a second restricting groove disposed on one side of the side plate; the second restricting block includes a restricting portion and a movable portion that are vertically connected, and the movable portion slides into the second restricting groove in an upper-to-lower direction, so that the restricting portion is fitted to an upper end of the second restricting groove.

8. The shelf as claimed in claim 7, wherein the second restricting groove includes two symmetrical second engaging hooks protruding from the side of the side plate, the movable portion of the second restricting block is in clearance fit with the second engaging hooks, and the restricting portion has a width greater than a distance between the second engaging hooks.

9. The shelf as claimed in claim 8, wherein an outer surface of each second engaging hook has a first guide slope.

10. The shelf as claimed in claim 8, wherein the width of the restricting portion gradually decreases from top to bottom.

11. The shelf as claimed in claim 7, wherein the second restricting groove is formed by two symmetrical ribs protruding from the side of the side plate.

12. The shelf as claimed in claim 1, wherein a third restricting mechanism is provided at the pivot joint of the bottom plate and the vertical plate; the third restricting mechanism includes an engaging buckle disposed on the side edge of the bottom plate and a third restricting block disposed on the side of the vertical plate; the engaging buckle protrudes from a lower surface of the side edge of the bottom plate, the third restricting block has a countersunk hole or through hole extending vertically, the engaging buckle is inserted in the third restricting block in an upper-to-lower direction, when the bottom plate is unfolded relative to the vertical plate, the third restricting block is restricted by the engaging buckle for restricting the unfolding angle of the bottom plate and the vertical plate.

13. The shelf as claimed in claim 1, wherein a protruding step is provided on the side of the side plate for supporting one end of the bottom plate.

14. The shelf as claimed in claim 1, wherein a fourth restricting mechanism is provided between the side plate and the vertical plate; the fourth restricting mechanism includes a restricting notch disposed on a side edge of the vertical plate and a fourth restricting block disposed on one side of the side plate, and the fourth restricting block is engaged in the restricting notch for restricting downward movement of the side plate relative to the vertical plate.

15. The shelf as claimed in claim 14, wherein the second restricting groove includes a plurality of second restricting grooves arranged in a plurality of rows corresponding in number to the vertical plate, and the fourth restricting block is located under a lowermost one of the second restricting grooves in the same row.

16. The shelf as claimed in claim 14, wherein an upper surface of the fourth restricting block has a second guide slope.

17. The shelf as claimed in claim 1, further comprising a restricting plate; the restricting plate having a receiving groove for receiving the vertical plate; the vertical plate further having a slide groove corresponding in position to the restricting plate; the vertical plate being inserted in the receiving groove of the restricting plate, and the restricting plate sliding in the slide groove of the vertical plate, so as to realize a vertical connection between the vertical plate and the restricting plate.

* * * * *